United States Patent [19]

Ishihara

[11] Patent Number: 4,963,927

[45] Date of Patent: Oct. 16, 1990

[54] ELECTROPHOTOGRAPHIC RECORDING APPARATUS HAVING A DEVELOPER RESUPPLY CONTROL FUNCTION

[75] Inventor: Hideshi Ishihara, Takatsuki, Japan

[73] Assignee: Matsushita Electric Industrial Co., Ltd., Osaka, Japan

[21] Appl. No.: 189,945

[22] Filed: May 3, 1988

[30] Foreign Application Priority Data

May 11, 1987 [JP] Japan ..... 62-114108
Dec. 25, 1987 [JP] Japan ..... 62-330808

[51] Int. Cl.[5] ..... G03G 15/06; B05C 11/00

[52] U.S. Cl. ..... 355/207; 355/208; 355/245; 355/326; 118/688

[58] Field of Search ..... 355/3 DD, 4, 14 D; 118/689, 688, 691

[56] References Cited

U.S. PATENT DOCUMENTS 3,693,581 9/1972 Quant .
3,981,272 9/1976 Smith et al. ..... 355/245 X
4,026,643 5/1977 Bergman ..... 355/14 D
4,226,525 10/1980 Sakamoto et al. ..... 355/14 D
4,413,264 11/1983 Cruz-Uribe et al. .

FOREIGN PATENT DOCUMENTS 0269266 10/1987 European Pat. Off. .
58-221868 12/1983 Japan .
58-224363 12/1983 Japan .
61-156071 7/1986 Japan .

*Primary Examiner*—R. L. Moses
*Attorney, Agent, or Firm*—Stevens, Davis, Miller & Mosher

[57] ABSTRACT

An electrophotographic recording apparatus comprises means for accurately detecting the amount of consumption of a developer still by means of a simple construction and also means for outputting a signal for indicating to resupply the developer at proper timing. Since the amount of consumption of the developer is substantially proportional to the number of illuminated dots produced by exposing means, a CPU reads, at every predetermined period, output count values of a counter, which counts the number of illuminated dots produced by the exposing means, and integrally adds up the output count values. Then, the CPU compares the integration result of the output count values with a predetermined value and thereby decides a shortage of the developer. On the other hand, since the deterioration of a developer is substantially proportional to the operation time period of developing means, the CPU integrally adds up the operation time periods of the developing means, compares the integration result of the operation time periods of the developing means with a predetermined time and thereby decides the deterioration of the developer. When the shortage or deterioration of the developer has been detected, the apparatus outputs a signal for indicating to resupply the developer.

9 Claims, 4 Drawing Sheets

ELECTROPHOTOGRAPHIC RECORDING APPARATUS HAVING A DEVELOPER RESUPPLY CONTROL FUNCTION

BACKGROUND OF THE INVENTION

1. Field of the Invention

The present invention relates to an electrophotographic recording apparatus including a copying apparatus, printer or the like.

2. Description of the Related Art

Hitherto, in an electrophotographic recording apparatus, when a shortage of a developer is detected, mere resupply of the developer has been made. But, no consideration has been given to the deterioration of a developer. It has been usual that a developer is renewed only when the maintenance service is rendered to the electrophotographic recording apparatus by a specialist.

As a method of detecting a shortage of a developer, there have been a method of measuring the transmission or reflection of light, a method of measuring a change of inductance, a method of counting illuminated dots produced by a laser, LED, etc. However, according to the above methods, the detecting means becomes generally expensive. Particularly, in the electrophotographic recording apparatus using developers of a plurality of colors, when the method of measuring the transmission or reflection of light is used, since the wavelengths of the transmitted light beams differ depending on the developers of respective colors, it becomes necessary that separate detecting means are arranged for respective colors or different filters are used for respective colors. As a result, the cost of the apparatus becomes extremely high and the size thereof becomes very large. On the other hand, when using the method of measuring an inductance change, since the degree of the inductance change differs between the developers of respective colors, the measuring accuracy is deteriorated.

As an example of counting luminous dots produced by a laser, LED or the like by using a counter, JP-A-58-224363 is known and the outline thereof is shown in FIG. 5. FIG. 5 schematically shows an essential part of a conventional recording apparatus. An electrostatic latent image carrying device 21 rotates in the direction of an arrow and is charged by a charging device 22 and is exposed by an LED array device 23. The LED array device 23 is selectively driven by a driver circuit **25*a* so as to emit light or to stop light emission in response to an image input signal, thereby forming a latent image on the electrostatic latent image carrying device 21. A developing apparatus 24 is arranged at a position next to the LED array device 23. The developing apparatus 24 has a developer supply tank 24*a*. A developer is supplied by driving supply rollers 24*b* attached to a supply port of the tank 24*a*. On the other hand, the supply rollers 24*b* are driven by a supply roller control circuit 25*b* of an automatic supply amount control apparatus 25 which controls a supply amount of a developer in response to light emitting times of an LED array 23*a* of the LED array device 23. Upon receipt of an image input signal, the driver circuit 25*a* drives the LED array device 23, and, at the same time, sends the image input signal to a counter circuit 25*c*. The counter circuit 25*c* counts a total number of illuminated dots produced by the actuated LEDs and sends an output count signal to a comparator circuit 25*e*. The comparator circuit 25*e* compares the total number of illuminated dots produced by the actuated LEDs with an output of a reference counter 25*d*. When the comparator circuit 25*e* detects that the total number of illuminated dots produced by the actuated LEDs has reached a reference value, the comparator circuit 25*e* sends an output signal to the supply roller control circuit 25*b*. In response thereto, the supply roller control circuit 25*b* drives the supply rollers 24*b* for a predetermined time period, thereby causing a predetermined amount of developer to be supplied from the developer supply tank 24*a* into a main body of the developing apparatus 24**.

As mentioned above, in the conventional electrophotographic recording apparatus which does not take the deterioration of a developer into consideration, there has been a problem such that the developer is deteriorated before a shortage of the developer occurs, thereby resulting in a reduction in the image density. On the other hand, in the conventional method of detecting a shortage of a developer, an expensive apparatus becomes necessary. Particularly, in the case of an electrophotographic recording apparatus using developers of a plurality of colors, the apparatus becomes all the more expensive.

SUMMARY OF THE INVENTION

It is an object of the present invention to provide an electrophotographic recording apparatus which can accurately detect the amount of consumption of a developer still by means of a simple construction and which has means for outputting a signal for indicating to resupply the developer at proper timing.

In order to solve the above-described problems, the present invention comprises, as the fundamental constituent elements, means for detecting a shortage of a developer, means for detecting the deterioration of a developer, and means for outputting a signal for indicating to resupply the developer when a shortage of the developer or the deterioration of the developer has been detected.

DESCRIPTION OF THE PREFERRED EMBODIMENTS

Figure 1:
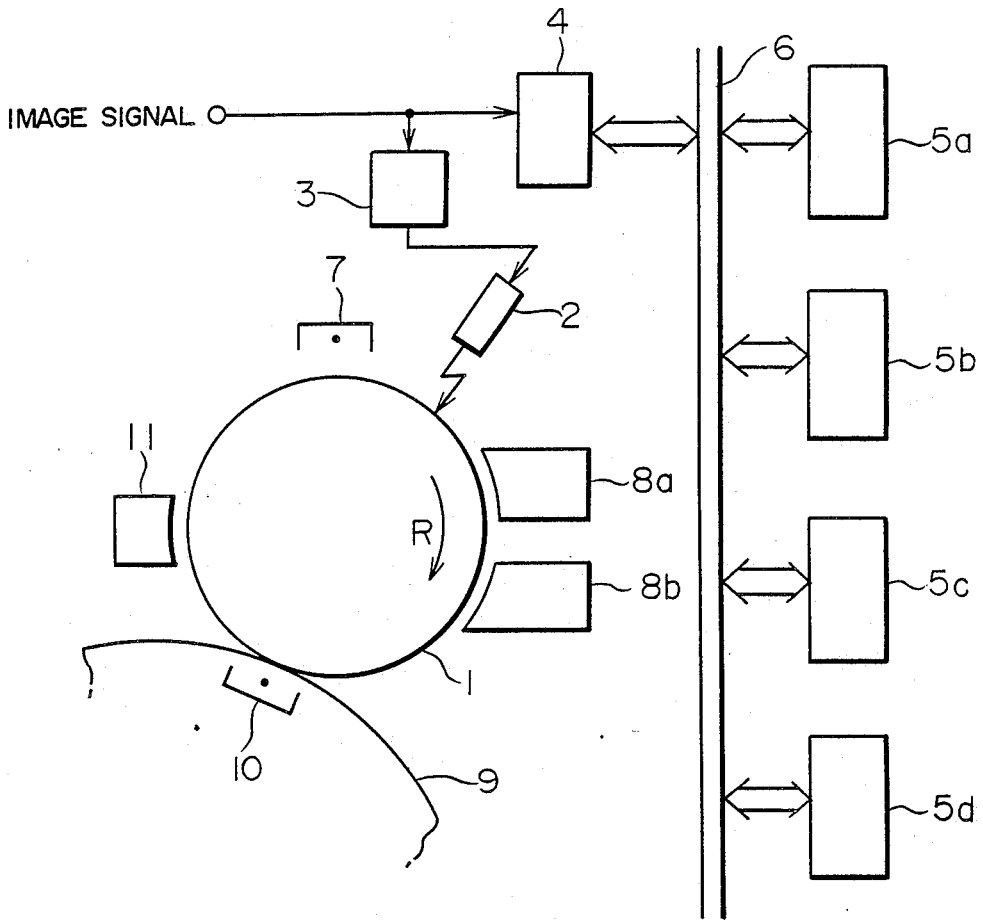
FIG. 1 is an explanatory drawing showing an electrophotographic recording apparatus of an embodiment of the present invention.

FIG. 1 is an explanatory drawing showing an electrophotographic recording apparatus having means for outputting a signal for indicating to resupply a developer according to the present invention. Reference numeral 1 denotes an electrostatic latent image carrying device. In this embodiment, the electrostatic latent image carrying device 1 is formed of an ordinary photosensitive material carrying drum in which a film of a photoconductive material such as selenium, etc. is formed on a cylinder made of aluminum or the like having a diameter of 100 mm. It is also possible to use an ordinary photosensitive sheet or the like having a coating of an organic photoconductive material, etc. Reference numeral 2 denotes exposing means or illuminating means such as a laser, LED, etc. The exposing means or illuminating means 2 is driven by the driver circuit 3 and forms a latent image on the latent image carrying device 1 on a dot unit basis. In this embodiment, the exposing means 2 is composed by a combination of an LED array including 2048 LEDs, which are arranged in one line of the length of 210 mm corresponding to the short side of A4 size and which has a recording density of 240 DPI, and a rod lens array of an angular aperture of 20°. The driver circuit 3 selectively drives the exposing means 2 so as to make the latter emit light or to stop light emission in response to an input image signal. Reference numeral 7 denotes an electrifier for electrifying the latent image carrying device 1 to have a predetermined surface potential before it is exposed by the exposing means 2. Reference numerals 8*a* and 8*b* designate developing apparatuses containing respective developers of different colors which cause the developers of the respective colors to electrostatically adhere to an electrostatic latent image formed on the latent image carrying device 1, thereby forming a visual image (toner image). Reference numeral 9 denotes a recording paper. An ordinary paper for copying apparatus use is used as the recording paper. Reference numeral 10 denotes a transfer electrifying device for transferring the visible image onto the recording paper 9. Reference numeral 4 denotes a counter 4 which inputs the image signal and counts the number of illuminated dots or the number of non-illuminated dots. Reference numeral 5*a* designates a CPU which reads a count value of the counter 4 at every predetermined period. In this embodiment, this predetermined period corresponds to each one-line subscanning period. Further, the number of LEDs comprised in the LED array is 2048. Therefore, a counter of the stage number capable of counting up to 2048 at its maximum, that is, eleven stages, may be used as the counter 4. The CPU 5*a* comprises means for detecting a shortage of a developer, means for detecting the deterioration of a developer, and means for outputting a signal for indicating to resupply a developer. Namely, in the operation of the means for detecting a shortage of the developer, the CPU 5*a* reads the count value of the counter 4 at every one-line subscanning and integrally adds the read count value to the total count value which has been stored in an RAM 5*c* by that time. The CPU 5*a* writes again the integration result into the RAM 5*c*, and further compares the integration result with a predetermined value of the developer amount which has been stored beforehand in an ROM 5*b*. When the integration result exceeds the predetermined value of the developer amount, it is decided that the developer has become insufficient. On the other hand, in the operation of the means for detecting the deterioration of the developer, when an image forming sequence is effected, the CPU 5*a* integrally adds the operation time period of the developing apparatus to the total operation time period which has been stored in the RAM 5*c* by that time, and then the CPU 5*a* writes the integration result into the RAM 5*c* as the integrated total operation time period of the developing apparatus. Further, the CPU 5*a* compares the integration result of the operation time period of the developing apparatus with a predetermined operation time which has been stored beforehand in the ROM 5*b*. When the integration result of the operation time period of the developing apparatus exceeds the predetermined operation time, it is decided that the developer is deteriorated. Further, in the operation of the means for outputting a signal for indicating to resupply the developer, when the shortage of the developer or the deterioration of the developer has been detected, the signal outputting means outputs a signal indicating to resupply the developer through an I/O port 5*d*. By virtue of this signal, it is possible to resupply a developer by means of a construction similar to that of a conventional apparatus. In the ROM 5*b*, there are stored a program of the CPU 5*a*, a predetermined developer amount, a predetermined operating time, etc. The predetermined developer amount can be determined by obtaining the relation between the number of illuminated dots or the number of non-illuminated dots and the amount of consumption of the developers of respective colors by experiment beforehand and by calculating the numbers of dots corresponding to the amounts of the developers of the respective colors in the developing apparatuses 8*a* and 8*b*. On the other hand, the predetermined operation time can be determined by obtaining the relation between the operation time periods of the developing apparatuses containing the developers of respective colors and the deterioration of the developers by experiment beforehand. The RAM 5*c* is used temporarily in the execution of a program in the arithmetic operation of the CPU 5*a*, and it has storage areas for storing the integrated count values for the respective colors and the operation time periods of the developing apparatuses. The RAM 5*c* is backed up by the provision of a battery (not shown), so that, even when a power source is switched off, data stored in the RAM 5*c* are prevented from being lost and the stored integrated count values and the operation time periods of the developing apparatuses are protected. The I/O port 5*d* is used when the CPU 5*a* outputs the signal indicating to resupply a developer. By virtue of this signal, it is possible to resupply the developers by means of a construction similar to that of a conventional apparatus in the same way as above mentioned. The counter 4, CPU 5*a*, ROM 5*b*, RAM 5*c* and I/O port 5*d* are connected through a bus line 6.

The image forming operation in the embodiment will now be described hereinbelow. In order to render the description easily understandable, an explanation will be made of an exemplified experiment wherein images of two different colors are formed on the electrostatic latent image carrying device 1 by the negative-positive development (reversal development) process which is used in a laser printer or the like, and then these images are transferred onto a recording paper in a lump.

Figure 2:
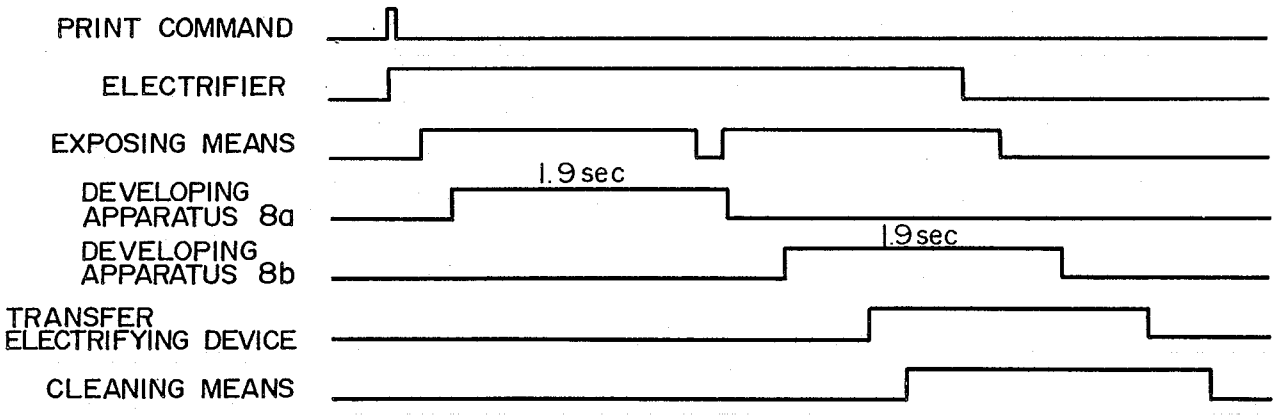
FIG. 2 is a timing chart showing an image forming operation in the embodiment of the present invention.

FIG. 2 is a timing chart of the image forming operation of the embodiment of the present invention. In response to the input of a print command, the image forming sequence is started. Then, the prescribed apparatuses are selectively controlled to operate or to be stopped at the timings shown in the timing chart of FIG. 2. Each of the operations of the apparatuses will now be described hereinbelow in the order of the timing chart of FIG. 2. Upon receipt of the print command, the latent image carrying device 1 is driven by a drive motor (not shown) in the direction indicated by R shown in FIG. 1 and it rotates at a uniform peripheral speed of about 160 mm/sec. During a first rotation of the latent image carrying device 1, a visible image (toner image) of a first color is formed. Firstly, the electrifier 7 is operated, whereby a high DC voltage of about +7 kV is applied between the casing and the core wire of the electrifier 7. The whole surface of the latent image carrying device 1 is electrified by the corona generated by the application of the high DC voltage so that the surface potential thereof becomes about +800 V. Subsequently, in accordance with an image signal to be formed by the first color, the driver circuit 3 selectively drives the exposing means 2 so as to make the latter emit light or to stop light emission. In the respective areas of the illuminated dots, the surface potential of the latent image carrying device 1 decreases within a range from +800 V (the initial surface potential) to +30 V (the residual potential) depending on the applied quantity of light, whereby a negative electrostatic latent image (not shown) is formed. Then, the developing apparatus 8*a* is actuated at the timing when the lead end of the electrostatic latent image reaches the position of the developing apparatus 8*a* so as to supply the developer (toner) of the first color, which has been electrified by the developing apparatus 8*a* to have a positive potential, and to make the developer adhere electrostatically to the surface portions of the latent image carrying device 1 having a low surface potential, thereby forming a visible image (toner image) (not shown) of the first color. Subsequently, during a second rotation of the latent image carrying device 1, a visible image of the second color is formed on the latent image carrying device 1. That is, while the latent image carrying device 1 continues rotating, the surface of the latent image carrying device 1 is electrified again by the electrifier 7; the exposure of the second color is started at the timing when the lead end of the visible image (toner image) of the first color reaches the position of the exposing means 2; in response to the image signal, the driver circuit 3 selectively controls the exposing means 2 to emit light or to stop light emission so that an electrostatic latent image (not shown) of the second color is formed on the latent image carrying device 1; and the developing device 8*b* is actuated at the timing when the lead end of the electrostatic latent image reaches the position of the developing apparatus 8*b* so as to supply the developer of the second color to the electrostatic latent image of the second color and thus to make the former adhere to the latter, thereby forming a visible image (toner image) (not shown) of the second color. In this manner, after the visible images (toner images) (not shown) of two different colors have been formed on the latent image carrying device 1, the recording paper 9 is fed by recording paper transfer means (not shown). The transfer electrifying device 10 is actuated at the timing when the lead end of the visible image reaches the position of the transfer electrifying device 10, and a high DC voltage of about −6 kV is applied between the casing and the core wire of the transfer electrifying device 10 to produce gaseous ions of a corona at an instant when the recording paper 9 is in close contact with the visible image on the latent image carrying device 1. The toner images of the two respective colors are transferred together onto the recording paper 9 by the corona. The recording paper 9 is transferred to fixing means (not shown) by peeling-off means and recording paper transfer means (not shown) so that the toner images are fixed there. On the other hand, cleaning means 11 is actuated at the timing when the lead end of the toner images left on the latent image carrying device 1 reaches the position of the cleaning means 11, so that unnecessary developers (toners) remaining on the latent image carrying device 1 are removed so as to be prepared for a next image forming operation.

The driver circuit 3 comprises a shift register, latch elements, a counter, logical elements, etc. (all of which are not shown). The image signal is inputted to the shift register and is serially transferred in synchronism with a transfer clock (DCLK). At the time when the image signal of one line, namely, data of 2048 pixels, have been transferred, it is converted into parallel data by applying a strobe signal to the latch elements, and the parallel data are held by the latch elements until the shift register is filled with data of a next line. Then, only the light emitting elements in the exposing means 2 corresponding to the dots representing the data content "1" emit light to thereby form an electrostatic latent image. Here, the strobe signal is produced through the processing, by the logical elements, of a plurality of signals which have been formed by using the transfer clock (DCLK).

Next, the means for detecting the deterioration of a developer in the embodiment of the present invention will be explained.

In this embodiment, the deterioration of a developer is detected by the CPU 5*a* by comparing the integration result of the operation time periods of the developing apparatus with a predetermined operation time period value which has been obtained beforehand by experiment and stored in the ROM 5*b*. However, the operation time period of the developing apparatus in a single image forming sequence of operation is a fixed length of time, so that, even by counting the number of operation times of the developing apparatus in place of the operation time periods of the developing apparatus, it becomes possible to obtain an integration sum of the operation time periods. Therefore, in place of the predetermined operation time period value, the number of times of operations corresponding to the predetermined operation time period value is adopted as a predetermined number of operations, and the latter is compared with the integration result of the operation time periods of the developing apparatus to thereby detect the deterioration of a developer.

As shown in the image forming timing chart of FIG. 2, in this embodiment, the operation time period of both developing apparatuses 8*a* and 8*b* in one image forming sequence is 1.9 seconds. On the other hand, the total operating time period of the developing apparatus before the developer is deteriorated has been obtained beforehand by experiment. The image forming operation was repeated at every predetermined time interval while the developing apparatus was continuously operated. The image concentration $D_{max}$ was 1.2 in the initial state. But after the elapse of 9.5 hours, the value of $D_{max}$ decreased to 1.0.

Therefore, in this embodiment, the state after the elapse of 9.5 hours is assumed to be the state where the developer is deteriorated. By converting this time period into the number of operations of the developing apparatus, 18000 is obtained. Thus, this value is stored in the ROM 5*b* as a value representing a predetermined number of operations of the developing apparatus.

Thus, each time a image forming sequence is executed, the CPU 5*a* reads the number of operations of the developing apparatus of each color from the RAM 5*c* and increases it by increment one and again stores the increased value into the RAM 5*c*. This value is compared with the value $4650 stored in the ROM 5*b* which is a hexadecimal numeration for 18000 and which represents a predetermined number of operations of the developing apparatus. When the total number of operations of the developing apparatus exceeds the predetermined number of operations, the CPU 5*a* decides that the developer is deteriorated.

A case of forming the image of two colors has been described with respect to the timing chart shown in FIG. 2. However, in a sequence for forming the image of only one of the two colors, every time this sequence is executed, only the integrated number of operations of the developing apparatus for the associated color is read out from the RAM 5*c* and is increased by increment one. The increased value is stored again into the RAM 5*c*, and at the same time it is compared with the predetermined number of operations.

In addition, in the operation of detecting the deterioration of a developer in the embodiment of the present invention, the detection is effected by comparing the number of operations of the developing apparatus with the predetermined operation time period value. However, the deterioration of a developer can be detected also by comparing the integration result of the number of output papers, on which images are formed, with a predetermined number of output papers.

Next, the means for detecting a shortage of a developer in the embodiment of the present invention will now be described.

Figure 3:
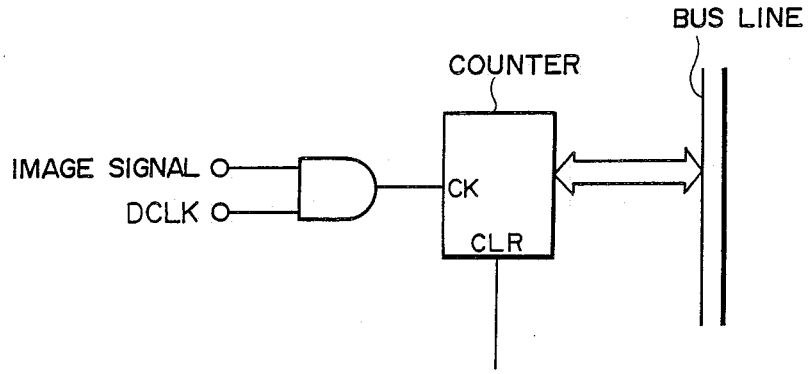
FIG. 3 is a block diagram showing an input section of the counter.
Figure 4:
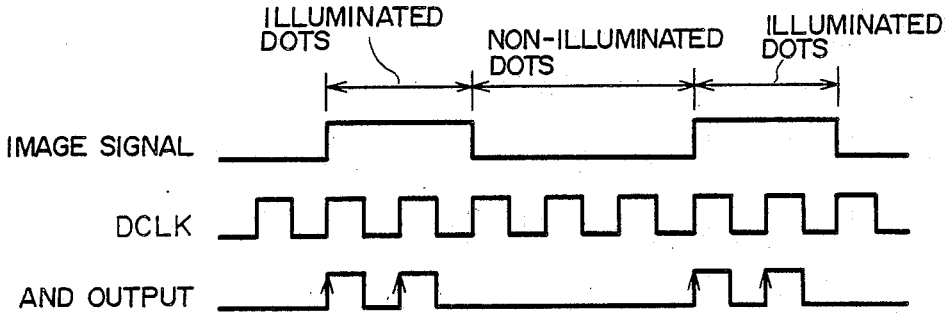
FIG. 4 is a timing chart showing the timing of signals appearing at the input section of the counter.
Figure 5:
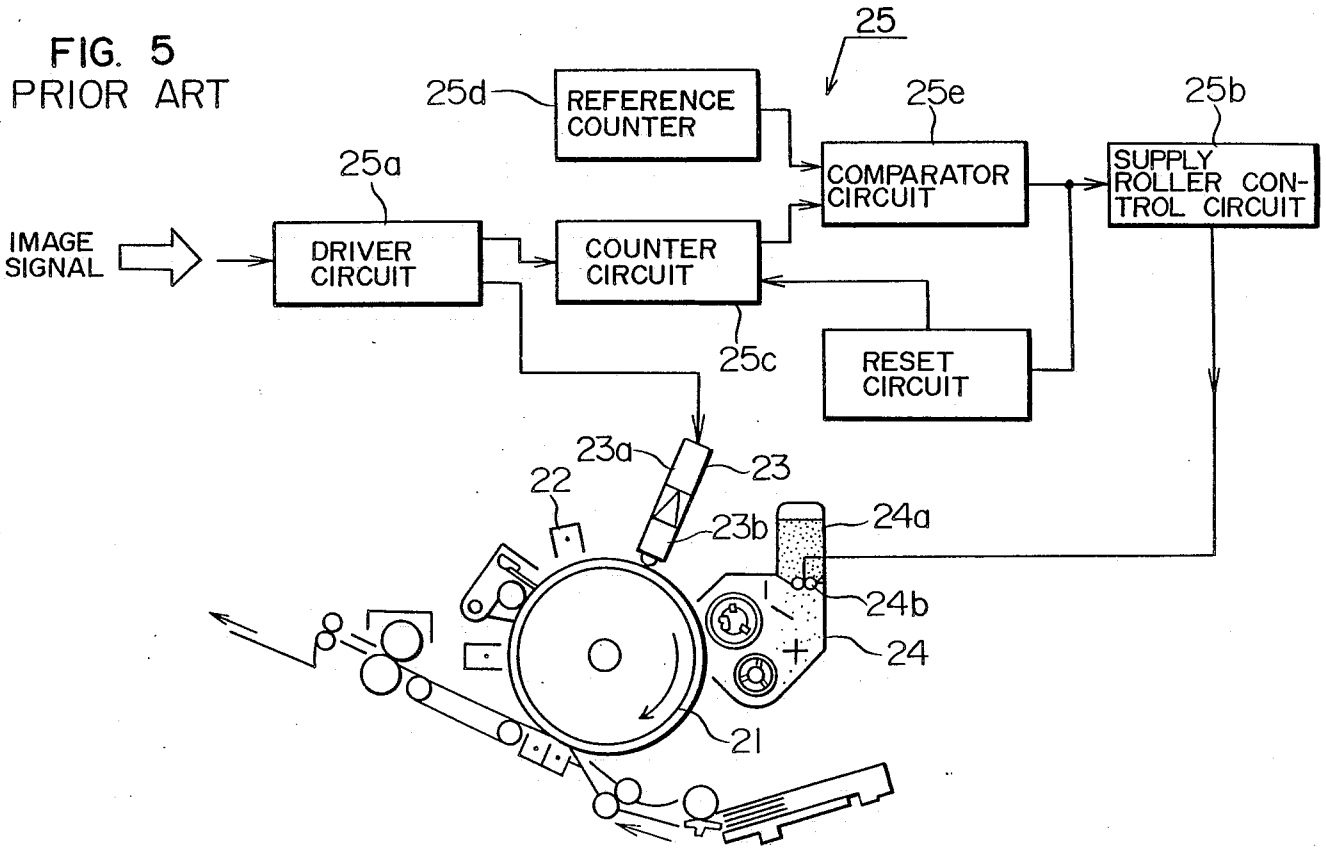
FIG. 5 PRIOR ART
FIG. 5 is an explanatory drawing showing a conventional electrophotographic recording apparatus.

As mentioned above, this embodiment relates to the negative-positive reversal development. The surface potential of the electrostatic latent image carrying device 1 corresponding to the illuminated dots decreases, and the developer, which has been electrified to have a positive potential, adheres to the portions of a low surface potential of the latent image carrying device 1. That is, the amount of consumption of a developer is practically proportional to the number of illuminated dots. Therefore, by counting the number of illuminated dots of each color, it becomes possible to detect the amount of consumption of the developer of each color. In the image signal of this embodiment, the illuminated dots correspond to the signal "1", while, the non-illuminated dots correspond to the signal "0", and both of the signals "1" and "0" are transferred in synchronism with the transfer clock (DCLK). Generally, a counter element counts up in response to the rising or falling edges of an input signal. Therefore, mere use of an input image signal does not make it possible to detect successive illuminated dots. Therefore, the input section of the counter 4 is constructed in a manner such that, as shown in FIG. 3, the logical AND of the image signal and the transfer clock (DCLK) is inputted to a clock input terminal of the counter element. FIG. 4 shows a timing chart for the dot illumination. By constructing the input section of the counter 4 as shown in FIG. 3, an input signal having rising or falling edges corresponding to the number of illuminated dots in the image signal is inputted as shown in FIG. 4, so that the output of the counter element is counted up only by the number of illuminated dots.

In this embodiment, the predetermined value for the developer stored in the ROM 5*b* has been obtained beforehand by experiment. There has been conducted an experiment in which an electrostatic latent image was formed by using an image signal which produces an image of an area ratio of 8% of an A4 size original, and this electrostatic latent image was developed by the developing apparatus. The result of the experiment showed that the amount of consumption of the developer was 40 mg per one sheet of paper. This value shows that the exposing means of the recording density of 240 DPI used in this embodiment produced about $4.46 * 10^5$ illuminated dots for the 8% original. Since each of the developers 8*a* and 8*b* used in this embodiment can store a developer of the amount of 160 g, by converting this value on the basis of the amount of consumption of the developer in the case of the 8% original, it results that the number of illuminated dots, which can be produced before the stored developer is exhausted, amounts to $2.67 * 10^9$ dots. Therefore, the value of $2.67 * 10^9$ is stored beforehand in the ROM 5*b* as a predetermined value of the amount of the developer.

Next, the operation of detecting a shortage of a developer when the image forming sequence is executed will now be described. Firstly, when a print command is inputted and the image forming sequence is started, an image signal corresponding to an image to be formed in the first color is inputted to the driver circuit 3 and the counter 4. The counter 4 counts up each time each illuminated dot in the image signal is inputted. When the CPU 5*a* detects that the image signal of one line has been transferred to the driver circuit 3 and the counter 4, the CPU 5*a* reads the outputt count of the counter 4, which has been increased by the number of illuminated dots contained in this line, through the bus line 6. Here, in order for the CPU 5*a* to read the output of the counter 4 for one line, as an example, the output of the counter 4 is latched by the above-mentioned strobe signal, and, at the same time, the CPU 5*a* is interrupted so that the latched output is read through a program which is executed in the interruption.

After the CPU 5*a* has read the output of the counter 4 for one line, the CPU 5*a* further adds this output count value to the integration result of the count values of the number of illuminated dots of the first color which is stored in the storage area for the first color in the RAM 5*c*. Further, the CPU 5*a* stores again the renewed integration result in the storage area for storing the integration result of the count values for the first color in the RAM 5*c*, and compares the renewed integration result with the predetermined value of the amount of the developer stored in the ROM 5*b*. If the integration result of the count values exceeds the predetermined value of the amount of the developer, the CPU 5*a* decides that the developer of the first color is insufficient. Besides, after the CPU 5*a* has read the output of the counter 4, it clears the counter 4 so that the counter 4 may be prepared for a counting operation in the subscanning of a next line. After the image of the first color has been formed in this way, as the image signal to be formed in the second color is subsequently inputted, the CPU 5*a* likewise detects a shortage of the developer of the second color, by using the predetermined value of the amount of the developer stored in the ROM 5*b* and the integration result of the count values of the number of illuminated dots of the second color stored in the RAM 5*c*. Thus, the above-mentioned process is repeated, and when the integration results of the count values of the number of illuminated dots of respective colors exceed the predetermined values of the developer amount for the respective colors, the CPU 5*a* decides a shortage of the developers of the respective colors, that is, the shortage of the developers in the respective developing apparatuses 8*a* and 8*b*.

Further, in the operation of detecting a shortage of a developer in this embodiment, a predetermined period at which the CPU 5*a* reads the count value of the counter 4 is assumed to be a one-line subscanning period. However, this period may be assumed to be an n-lines subscanning period, where n≧2. Alternatively, it is clear that, instead of reading all the count values of the counter 4 by the CPU 5*a*, a similar result can be obtained by a method in which the CPU 5*a* is interrupted at the rising edge of the most significant bit of the counter 4 and the CPU 5*a* counts the number of interruptions and converts the count value into the total number of illuminated dots. In this case, it is not necessary that the number of stages of the counter 4 is capable of counting all the dots of the LED array. Thus, the structure of the counter 4 can be simplified by reducing the number of stages of the counter 4.

Further, since the image forming operation in the above-described embodiment is based on the negative-positive development (reversal development), the arrangement has been made so that the counter 4 counts the number of illuminated dots. However, in the case of the positive-positive development (normal or nonreversal development) in which the non-illuminated dots are used to form a visible image, it is arranged that the counter 4 counts the number of non-illuminated dots. In this case, the number of non-illuminated dots can be counted by using an inverted signal of an image signal as an input signal to the counter 4 in FIG. 1.

In the foregoing description of the embodiments of the present invention, the construction and operation of each of the means for detecting the deterioration of a developer and the means for detecting a shortage of a developer have been explained. Besides, the means for outputting a signal for indicating to resupply a developer may also be constituted by using the same CPU 5*a*, I/O port 5*d*, etc. Each time the CPU 5*a* detects the deterioration or a shortage of a developer of either one of the first and second colors, the CPU 5*a* outputs a signal for indicating to resupply the developer of the associated color from the I/O port 5*d* through the bus line 6. In response to this signal, an operator can supply an appropriate developer to the associated developing apparatus 8*a* or 8*b*. Upon confirming the completion of resupplying the appropriate developer, the CPU 5*a* clears the integration result of the operation time periods of the associated developing apparatus and the integration result of the count values of the number of illuminated dots of the associated color, respectively, which are stored in the RAM 5*c*. Thus, the CPU 5*a* is prepared for next detecting operations for detecting the deterioration and a shortage of a developer, respectively.

In the foregoing embodiments of the present invention, a signal for indicating to resupply a developer is outputted when the deterioration or a shortage of the developer is detected. However, it is needless to say that the present invention is also applicable to an electrophotographic recording apparatus having a construction such that a developing apparatus or a developer cartridge is exchanged instead of resupplying a developer.

Further, it will be clearly understood that the present invention is not restricted only to the above-described embodiments, but the present invention is also effectively applicable to an electrophotographic recording apparatus which forms an image having a single color or an image having two or more colors.

I claim:

1. An electrophotographic recording apparatus, comprising:

means for detecting a shortage of a developer;

means for detecting a deterioration of the developer; and means for outputting a signal indicating a need to resupply the developer when the shortage or deterioration of the developer has been detected;

said means for detecting the shortage of developer comprising:

a counter for counting the number of illuminated dots or the number of non-illuminated dots in an image signal;

means for sending the image signal to exposing means and also to said counter;

a CPU for reading out a count value of said counter at predetermined periods and integrally adding up the readout count values, comparing the integration result of the count values with a predetermined value, and deciding that the developer contained in a developing means is insufficient, when the integration result of the count values exceeds the predetermined value;

means for storing the integration result of the count values; and means for storing the predetermined value, wherein said CPU is interrupted by a signal indicative of the most significant bit of said counter, said CPU counts the number of interruption times and compares the interruption time count value with a predetermined value which has been set beforehand, and when the interruption time count value exceeds the predetermined value, the CPU outputs a signal representing a shortage of the developer contained in said developing means.

2. An electrophotographic recording comprising:

exposing means for forming a latent image on an electrostatic latent image carrying device;

developing means for making a developer electrostatically adhere onto the latent image thereby to form a visible image;

a counter for counting the number of illuminated dots or the number of non-illuminated dots in an image signal;

means for sending the image signal to said exposing means and also to said counter;

a CPU for reading out a count value of said counter at every predetermined period and integrally adding up the readout count values, comparing the integration result of the count values with a predetermined value, and deciding that the developer contained in said developing means is insufficient, when the integration result of the count values exceeds the predetermined value;

a RAM for storing the integration result of the count values; and a ROM for storing the predetermined value, wherein said CPU is interrupted by a signal indicative of the most significant bit of said counter, said CPU counts the number of interruption times and compares the interruption time count value with a predetermined value which has been set beforehand, and when the interruption time count value exceeds the predetermined value, the CPU outputs a signal representing a shortage of the developer contained in said developing means.

3. An electrophotographic recording apparatus comprising:

means for detecting a shortage of a developer;

means for detecting a deterioration of the developer; and means for outputting a signal indicating a need to resupply the developer when the shortage or deterioration of the developer has been detected;

said means for detecting the deterioration of the developer comprising:

a CPU for integrally adding up a number of output recording papers, comparing the integration result, of the number of output recording papers with a predetermined value, and deciding that the developer is deteriorated when the integration result of the number of output recording papers exceeds the predetermined value;

means for storing the integration result of the output recording papers; and means for storing the predetermined value.

4. An electrophotographic recording apparatus capable of controlling resupply of a developer contained in a developing means, comprising:

means for detecting a shortage of the developer;

means for detecting a deterioration of the developer; and means for outputting a signal for instructing resupply of the developer when said shortage or deterioration of the developer has been detected;

wherein said means for detecting a shortage of the developer includes:

a counter for counting the number of illuminated dots or the number of non-illuminated dots in an image signal;

a path for sending the image signal to said counter, said path being adapted to be arranged in parallel with a path for sending the image signal to an exposure means;

first CPU means for reading out a count value of said counter at predetermined periods and integrally adding up the readout count values, comparing an integration result of the number of dots with a predetermined value of the number of dots, and deciding that the developer contained in said developing means is insufficient when the integration result of the number of dots exceeds the predetermined value of the number of dots;

first RAM means for storing the integration result of the number of dots; and first ROM means for storing the predetermined value of the number of dots; and wherein said means for detecting a deterioration of the developer includes:

second CPU means for integrally adding up operating time periods of said developing means, comparing an integration result of the operating time periods with a predetermined value of the operating time periods and deciding that the developer is in a deteriorated condition when the integration result of the operating time periods exceeds the predetermined value of the operating time periods;

second RAM means for storing the integration result of the operating time periods; and second ROM means for storing the predetermined value of the operating time periods.

5. An electrophotographic recording apparatus capable of controlling resupply of a developer contained in a developing means according to claim 4, wherein the recording apparatus has a plurality of developing means provided to contain developers of a plurality of colors, respectively, wherein:

said first RAM means is provided with a plurality of storage areas for respectively storing integration results of the numbers of dots for the respective colors;

said first ROM means stores predetermined values of the numbers of dots for the respective colors; and said first CPU means compares the integration results of the numbers of dots for the respective colors with the predetermined values of the numbers of dots for the respective colors, and decides that the developer of a particular color is insufficient when the integration result of the number of dots for the particular color exceeds a predetermined value of the number of dots of the particular color; and wherein:

said second RAM means is provided with a plurality of storage areas for respectively storing integration results of the operating time periods of the plurality of developing means for the respective colors;

said second ROM means stores predetermined values of the operating time periods of the plurality of developing means for the respective colors; and said second CPU means compares the integration results of the operating time periods of the plurality of developing means for the respective colors with the predetermined values of the operating time periods of the plurality of the developing means for the respective colors, and decides that the developer of a particular color in a deteriorated condition when the integration result of the operating time periods of the developing means for the particular color exceeds the predetermined value for the operating time periods of the developing means for the particular color.

6. An electrophotographic recording apparatus capable of controlling resupply of a developer contained in a developing means according to claim 4, wherein:

said first CPU means and said second CPU means are included in a single CPU;

said first RAM means and said second RAM means are included in a single RAM; and said first ROM means and said second ROM means are included in a single ROM.

7. An electrophotographic recording apparatus capable of controlling resupply of a developer contained in a developing means according to claim 5, wherein:

said first CPU means and said second CPU means are included in a single CPU;

said first RAM means and second RAM means are included in a single RAM; and said first ROM means and second ROM means are included in a single ROM.

8. An electrophotographic recording apparatus capable of controlling resupply of a developer contained in a developing means, comprising:

means for detecting a shortage of the developer;

means for detecting a deterioration of the developer; and means for outputting a signal instructing resupply of the developer when said shortage or deterioration of the developer has been detected, wherein said means for detecting a shortage of the developer includes:

a counter for counting the number of illuminated dots or the number of non-illuminated dots in an image signal;

a path for sending the image signal to said counter, said path being adapted to be arranged in parallel with a path for sending the image signal to an exposure means;

first CPU means for reading out a count value of said counter at predetermined periods and integrally adding up the readout count values, comparing an integration result of the number of dots with a predetermined value of the number of dots, and deciding that the developer contained in said developing means is insufficient when the integration result of the number of dots exceeds the predetermined value of the number of dots;

first RAM means for storing the integration result of the number of dots; and first ROM means for storing the predetermined value of the number of dots; and wherein said means for detecting a deterioration of the developer includes:

second CPU means for integrally adding up the number of output papers output by said recording apparatus, comparing an integration result of the number of said output papers with a predetermined value representing a given number of output papers and deciding that the developer is in a deteriorated condition when the integration result of the number of output papers exceeds the predetermined value representing the given number of output papers;

second RAM means for storing the integration result of the number of output papers; and second ROM means for storing the predetermined value representing the given number of output papers.

9. An electrophotographic recording apparatus capable of controlling resupply of a developer contained in developing means according to claim 8, wherein:

said first CPU means and said second CPU means are included in a single CPU;

said first RAM means and said second RAM means are included in a single RAM; and said first ROM means and said second ROM means are included in a single ROM.

* * * * *